US009810240B2

(12) United States Patent
Furusawa et al.

(10) Patent No.: US 9,810,240 B2
(45) Date of Patent: Nov. 7, 2017

(54) WATER PUMP AND METHOD FOR PRODUCING WATER PUMP

(71) Applicant: Hitachi Automotive Systems, Ltd., Hitachinaka-shi, Ibaraki (JP)

(72) Inventors: Yusuke Furusawa, Novi, MI (US); Masahiko Watanabe, Yokohama (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/108,102

(22) PCT Filed: Nov. 4, 2014

(86) PCT No.: PCT/JP2014/079208
§ 371 (c)(1),
(2) Date: Jun. 24, 2016

(87) PCT Pub. No.: WO2015/098293
PCT Pub. Date: Jul. 2, 2015

(65) Prior Publication Data

US 2016/0319831 A1 Nov. 3, 2016

(30) Foreign Application Priority Data

Dec. 27, 2013 (JP) ..... 2013-270934

(51) Int. Cl.
*F04D 29/42* (2006.01)
*F04D 29/10* (2006.01)
(Continued)

(52) U.S. Cl.
CPC ..... *F04D 29/426* (2013.01); *F01P 5/10* (2013.01); *F04D 13/02* (2013.01); *F04D 29/04* (2013.01);
(Continued)

(58) Field of Classification Search
CPC ..... F04D 29/04; F04D 29/106; F04D 29/126; F04D 29/426; F04D 29/4266;
(Continued)

(56) References Cited

U.S. PATENT DOCUMENTS 4,911,610 A 3/1990 Olschewski et al.
5,217,350 A 6/1993 Kimura et al.

FOREIGN PATENT DOCUMENTS

JP 63-302200 A 12/1988
JP 4-262096 A 9/1992
(Continued)

OTHER PUBLICATIONS

International Search Report (PCT/ISA/210) issued in PCT Application No. PCT/JP2014/079208 dated Feb. 3, 2015 with English translation (5 pages).
(Continued)

*Primary Examiner* — Ninh H Nguyen
*Assistant Examiner* — Brian P Wolcott
(74) *Attorney, Agent, or Firm* — Crowell & Moring LLP

(57) ABSTRACT

A pump is provided which includes a pump housing, a drive shaft rotatably installed in the pump housing through a ball bearing, a pulley integrally connected to one end of the drive shaft through a flange wall, an impeller connected to the other end of the drive shaft, a cylindrical base part integrally connected to an outer periphery of the flange wall and six through openings formed in an outer peripheral part of the flange wall, in which each of the through openings has, at a generally middle part of a bottom surface of an inner surface thereof, a pathway groove that extends substantially along an inner cylindrical surface of the cylindrical base part, so that the performance of discharging water, dust and the like from the through openings formed in the flange wall is increased.

10 Claims, 11 Drawing Sheets

(51) Int. Cl.

| | |
|---|---|
| ***F04D 29/04*** | (2006.01) |
| ***F04D 29/12*** | (2006.01) |
| ***F04D 29/043*** | (2006.01) |
| ***F01P 5/10*** | (2006.01) |
| ***F04D 13/02*** | (2006.01) |
| *F01P 7/14* | (2006.01) |
| *F04D 1/00* | (2006.01) |

(52) U.S. Cl.
CPC ..... *F04D 29/043* (2013.01); *F04D 29/106* (2013.01); *F04D 29/126* (2013.01); *F04D 29/4266* (2013.01); *F01P 2007/143* (2013.01); *F04D 1/00* (2013.01); *F05B 2260/602* (2013.01); *F05B 2260/603* (2013.01); *F05D 2260/4021* (2013.01); *F05D 2260/6022* (2013.01)

(58) Field of Classification Search
CPC ..... F04D 13/02; F05B 2260/602; F05B 2260/603; F05D 2260/421; F01P 5/00; F01P 5/10; F01P 2007/143
USPC ..... 416/170 R
See application file for complete search history.

(56) References Cited

FOREIGN PATENT DOCUMENTS

| | | | | |
|---|---|---|---|---|
| JP | 6-87767 | U | | 12/1994 |
| JP | 2004-116486 | A | | 4/2004 |
| JP | 2012-112342 | A | | 6/2012 |
| JP | 2012112342 | A | * | 6/2012 |

OTHER PUBLICATIONS

Japanese-language Written Opinion (PCT/ISA/237) issued in PCT Application No. PCT/JP2014/079208 dated Feb. 3, 2015 (4 pages).

* cited by examiner

WATER PUMP AND METHOD FOR PRODUCING WATER PUMP

TECHNICAL FIELD

The present invention relates to both a water pump used for pumping a cooling water into an interior of an internal combustion engine to cool the internal combustion engine, and a method for producing the water pump.

BACKGROUND ART

An existing water pump is described in Japanese Laid-open Patent Application 2004-116486.

The existing water pump has a pump housing having therein a pump chamber, a drive shaft rotatably supported in the pump chamber, a pulley connected to one end of the drive shaft through a discal end wall, a ball bearing provided between the pulley and the pump housing to rotatably support the pulley, an impeller connected to the other end of the drive shaft to integrally rotate therewith and a mechanical seal provided between the impeller and the pulley.

The discal end wall is formed with a plurality of through holes that are arranged in a circumferential direction at evenly spaced intervals. Each of the through holes has such functions as to allow insertion of a tool therethrough to press an outer race of the ball bearing onto an inner cylindrical surface of the pulley at the time of assembling the water pump and as to allow water leaked from the interior of the pump housing through the mechanical seal to be discharged to the outside.

In the existing water pump, however, the through holes are placed near the center of the discal end wall. Due to such placement of the through holes, the function as to allow discharging of leaked water through the mechanical seal to the outside becomes poor, and due to the leaked water poor discharging, it often occurs that foreign substances such as water, dust and the like that might enter the pump housing (in other words, enter the ball bearing) through the through holes are not easily discharged to the outside.

The present invention is provided by taking the actual situation of the hitherto used water pump into consideration and aims to provide a water pump that is improved in dischargeability of foreign substances such water, dust and the like to the outside through the through holes.

SUMMARY OF INVENTION

The invention defined in claim 1 relates to a water pump, particularly to a feature of the water pump in which a discal end wall of a pulley is formed with a plurality of through holes that extend in an axial direction to connect inside and outside of the end wall, and each of the through holes is formed at a radially outer side of an inner peripheral surface thereof with a pathway groove that penetrates approximately along an inner peripheral surface of the tubular base section in a radially outside direction.

In accordance with the present invention, the dischargeability of water or the like to the outside through the through holes can be improved.

EMBODIMENTS FOR CARRYING OUT INVENTION

In the following, embodiments of the water pump of the present invention will be described in detail with reference to the accompanying drawings.

First Embodiment

The water pump shown is applied to a cooling device by which an unfreezing fluid (ethylene glycol) is recirculated between a radiator and an internal combustion engine of a motor vehicle.

Figure 1:
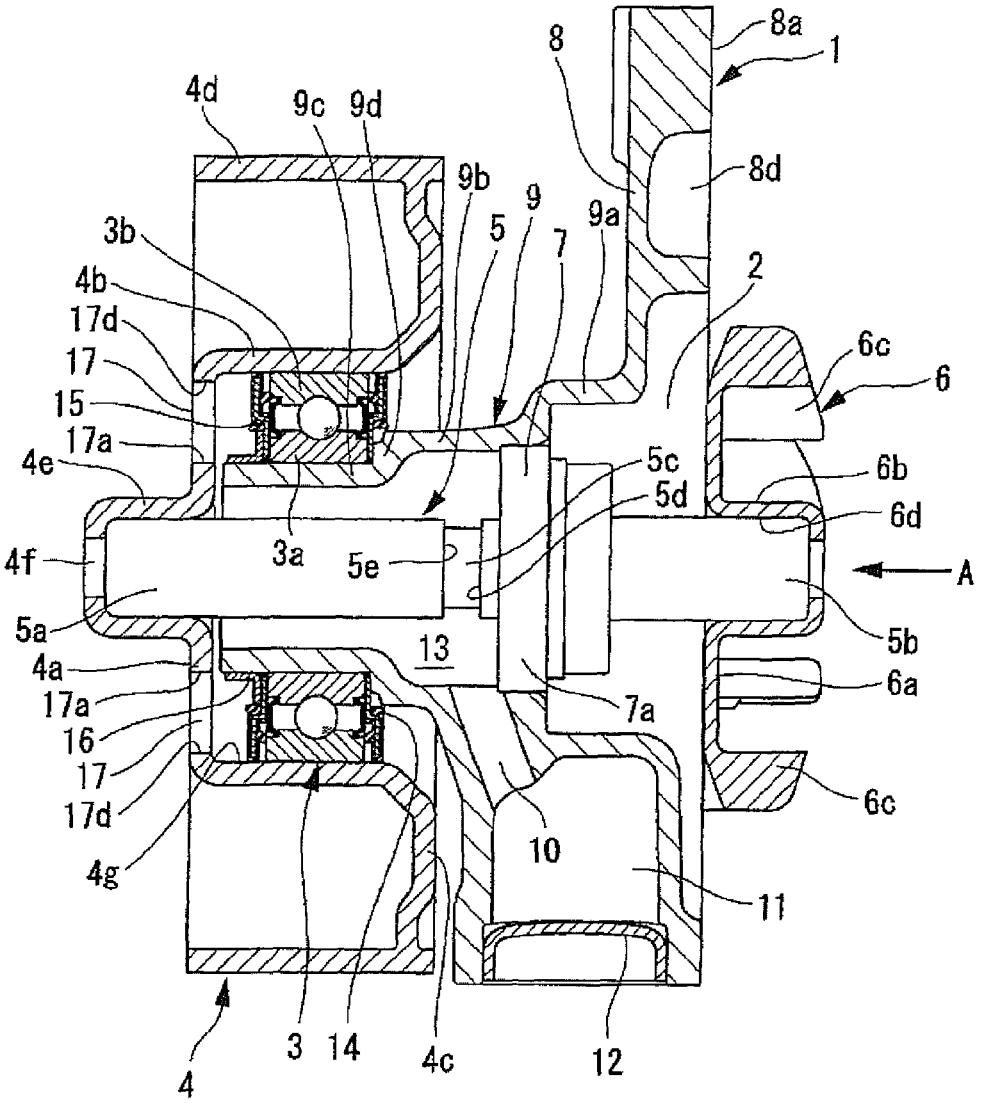
FIG. 1 is a vertically sectioned view of a water pump of a first embodiment of the present invention.
Figure 2:
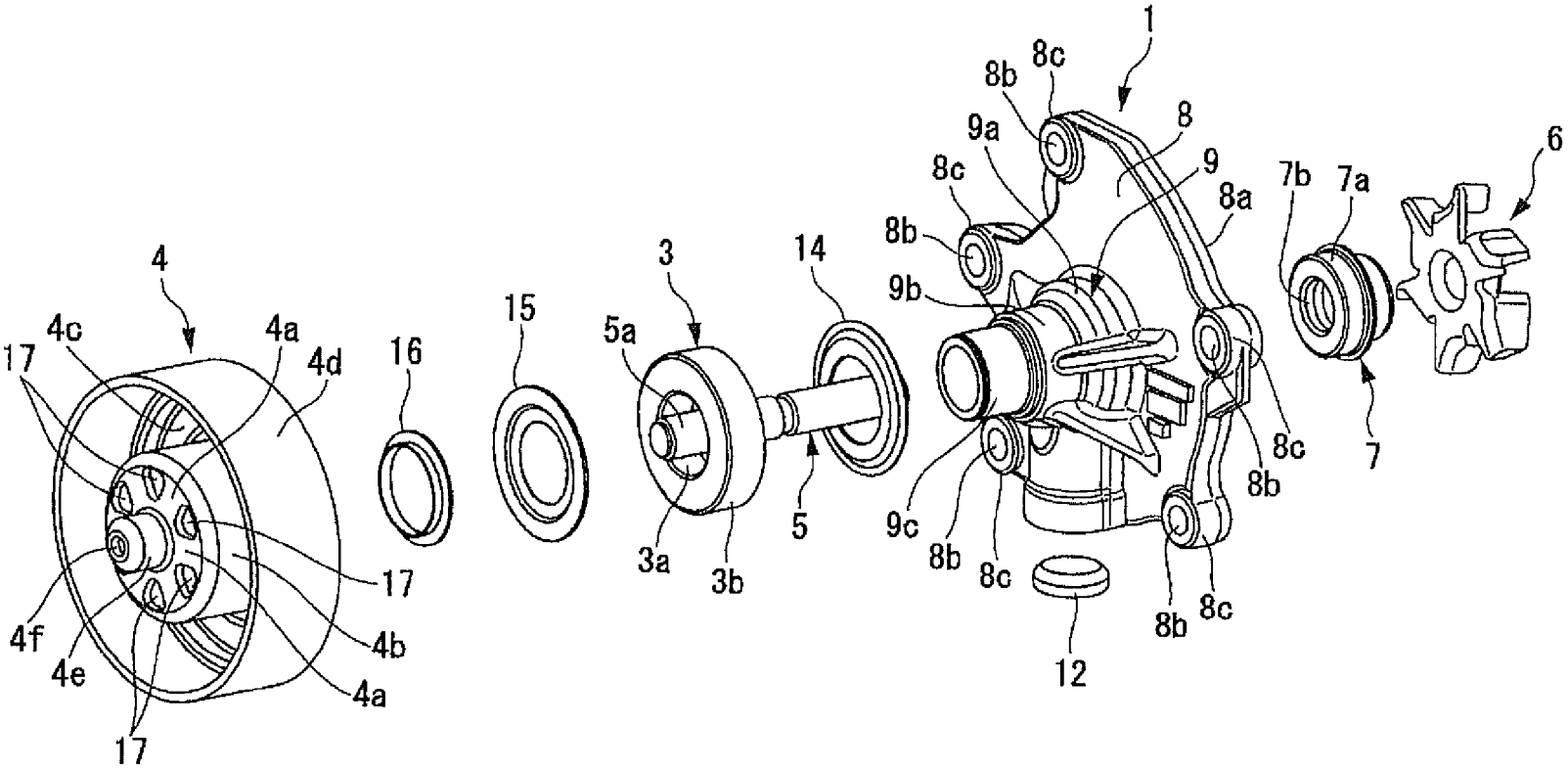
FIG. 2 is an exploded perspective view of the water pump of the embodiment.
Figure 3:
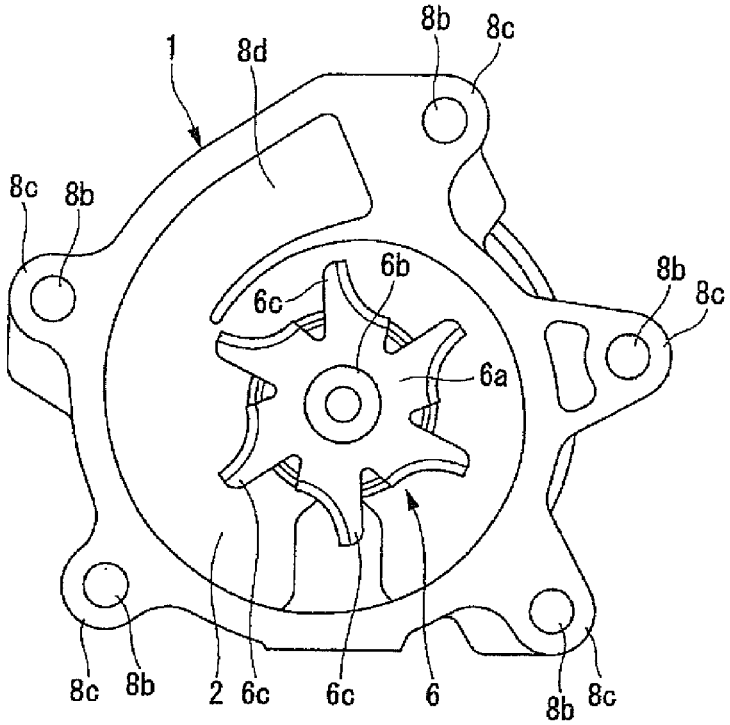
FIG. 3 is a view of a portion indicated by an arrow A of FIG. 1.

As is seen from FIGS. 1 to 3, the water pump is bolted to a side part of a cylinder block (not shown) of the internal combustion engine, and mainly comprises a pump housing 1 that has a pump chamber 2 at a front part thereof near the cylinder block, a pulley 4 that is placed at a front side of the pump housing 1 and rotatably held by only one ball bearing 3, a drive shaft 5 that is passed through an interior of the pump housing 1 and has one end 5*a* connected to the pulley 4, an impeller 6 that is connected to the other end of the drive shaft 5 and rotatably received in the pump chamber 2 and a mechanical seal 7 that is interposed between the pump housing 1 and the drive shaft 5 to hermetically seal a connection between the pump chamber 2 and the ball bearing 3.

The pump housing 1 is integrally constructed of an aluminum alloy, and has both a housing body 8 that defines therein the pump chamber 2 and has an annular ring like shape and a stepped cylindrical portion 9 that projects backward from the housing body 8.

The housing body 8 has an annular flat mounting face 8*a* that is to be in contact with a flat face possessed by a side part of the cylinder block and has at a peripheral portion thereof a plurality of boss portions 8*c* with respective bolt holes 8*b* through which connecting bolts pass to be screwed to the cylinder block.

In the housing body 8, there is defined an outlet port 8*d* from which a cooling water, which has been led into the pump chamber 2 from an inlet port located at the side of a radiator (not shown), is discharged to a water jacket of the cylinder block in response to rotation of the impeller 6.

As is seen from FIGS. 1 and 2, the cylindrical portion 9 is constructed to have a larger diameter part 9*a* that is placed at the side of the pump chamber 2, a medium diameter part 9*b* that is projected from the larger diameter part 9*a* toward the ball bearing 3 and a smaller diameter part 9*c* that is projected from the medium diameter part 9*b* toward one end of the drive shaft 5.

The medium diameter part 9*b* is formed at a gravitationally lower portion thereof with a vertically extending drain hole 10 for draining drops of water that may leak from the mechanical seal 7, and at a lower side of the drain hole 10, there is formed a drain chamber 11 for reserving therein the water drops, the drain chamber being constructed to straddle an interior of the larger diameter part 9*a*. A lower open end of the drain chamber 11 is hermetically sealed by a drain cap 12.

The medium diameter part 9*b* is formed at a gravitationally upper portion thereof with an atmosphere-open hole (not shown) through which the cooling water that might leak from the mechanical seal 7 and vapor of the cooling water that might be reserved in the drain chamber 11 are discharged to the outside. Furthermore, between an inner cylindrical surface of the medium diameter part 9*b* and the drive shaft 5, there is defined an annular space chamber 13 that is communicated with both the drain hole 10 and the atmosphere-open hole in an up-and-down direction. An outer cylindrical wall of the medium diameter part 9*b* is formed with an atmosphere-open passage (not shown) through which the above-mentioned atmosphere-open hole is communicated with the outside.

The ball bearing 3 is of a conventional type, and as is seen from FIGS. 1 and 2, the ball bearing 3 comprises an inner race 3*a* that is press-fitted to the smaller diameter part 9*c*, an outer race 3*b* that is press-fitted to an inner cylindrical surface 4*g* of an after-mentioned cylindrical base part 4*b* of the pulley 4 and a plurality of balls that that are rotatably received between the inner and outer races 3*a* and 3*b* through a holder.

The inner race 3*a* takes the most pressed axial position by being pressed against an annular projected portion 9*d* formed at a front end of the medium diameter part 9*b* of the cylindrical portion 9, and the outer race 3*b* is pressed or positioned to a certain position in the pulley 4 due to the positioning of the inner race 3*a*.

As is seen from FIGS. 1 and 2, the ball bearing 3 is provided at axial front and rear ends thereof with paired first and second seal members 14 and 15 for preventing intrusion of dust into the interior of the ball bearing 3, and these seal members 14 and 15 are arranged to cover axial ends of the ball bearing 3 while facing to each other.

The first seal member 14 is tightly put between the annular projected portion 9*d* of the medium diameter part 9*b* and one end of the inner race 3*a*. While, the second seal member 15 is tightly put between the other end of the inner race 3*a* and a retainer 16 that is a holding member.

As is seen from FIGS. 1 to 4, the pulley 4 is produced by pressing an after-mentioned metal plate into a given shape that mainly comprises a flange wall 4*a* that is a discal end wall arranged at one end of the drive shaft 5, a larger diameter cylindrical base part 4*b* that is bent in an axial direction of the drive shaft 5 from an outer periphery of the flange wall 4*a* and an annular belt-holding part 4*d* that is connected to an end part of the cylindrical base part 4*b* through a discal connecting wall 4*c*.

Figure 4:
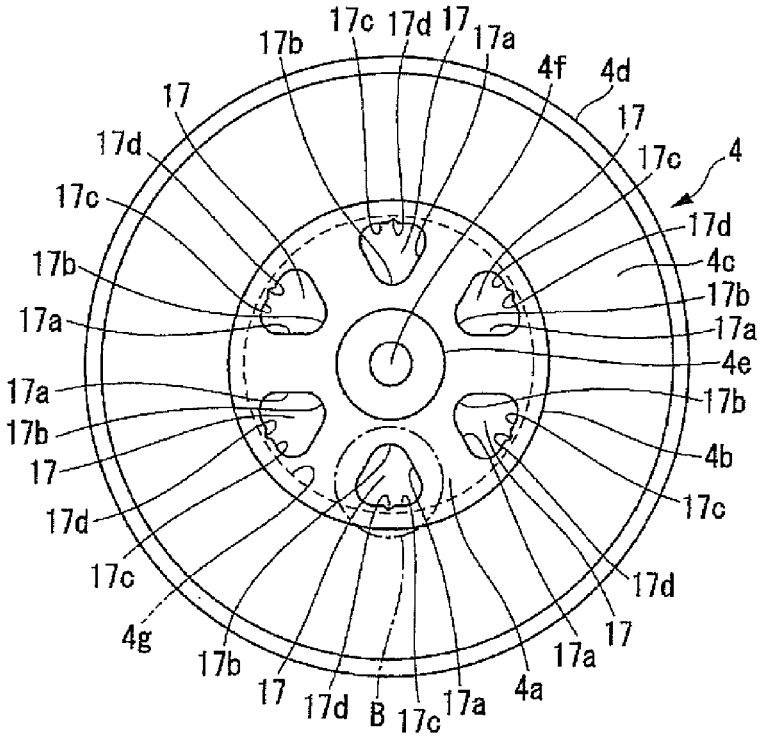
FIG. 4 is a front view of a pulley employed in the embodiment.

As is seen from FIGS. 1, 2 and 4, the flange wall 4*a* is integrally formed with a bottomed cylindrical part 4*e* into which an end part 5*a* of the drive shaft 5 is press-fitted, and the flange wall 4*a* is further formed at a peripheral portion thereof with six axially extending through openings 17 that are arranged in the peripheral portion at evenly spaced intervals.

The cylindrical part 4*e* is formed with an air bleed through opening 4*f* that effects air bleeding when the end part 5*a* of the drive shaft 5 is press-fitted into a center position of the bottom wall of the cylindrical part 4*e*.

The above-mentioned belt-holding part 4*d* has an outer surface whose vertical section is shaped like wave-like teeth. Although not shown in the drawing, around the belt-holding part 4*d*, there is put a part of a transmission belt that has another part put around a drive pulley fixed to a leading end of a crankshaft, so that transmission of a rotation force is carried out.

As is seen from FIGS. 1 and 2, the drive shaft 5 is made of an iron-based metal and has a stepped cylindrical outer surface and comprises the one end part 5*a* that is axially connected to the center of the flange wall 4*a*, the other end part 5*b* that is axially press-fitted to the center of the impeller 6 and a smaller diameter shaft part 5*c* provided at a generally middle portion of the drive shaft.

The end part 5*a* and the other end part 5*b* are generally the same in outer diameter and the outer diameter of the smaller diameter shaft part 5*c* is smaller than that of the end parts 5*a* and 5*b*. The smaller diameter shaft part 5*c* is exposed to the annular space chamber 13 so that leaked water from the mechanical seal 7 and thus running on the cylindrical outer surface is cut or separated by opposed stepped edges 5*d* and 5*e* before being guided into the drain chamber 11 from the annular space chamber 13 through the drain hole 10.

The impeller 6 is integrally constructed of a metal material such as aluminum alloy or the like, and as is seen from FIGS. 1 to 3, the impeller 6 comprises a generally disc-shaped base part 6*a*, a tubular fixing part 6*b* that axially extends from a front central portion of the base part 6*a* and eight blades 6*c* that radially outwardly extend from an outer cylindrical surface of the tubular fixing part 6*b*.

The base part 6*a* is shaped to have a given thickness and arranged to rotate behind a back face of the pump chamber 2 with a certain clearance kept therebetween. The tubular fixing part 6*b* is formed with an axially extending fixing hole 6*d* into which the other end part 5*b* of the drive shaft 5 is press-inserted.

The mechanical seal 7 is of a commonly used type and comprises a cartridge part 7*a* that is fixed to an inner cylindrical surface of the medium diameter part 9*b* of the cylindrical portion 9, a sleeve part 7*b* that is supported on an outer cylindrical surface of the drive shaft 5, and a seal part (not shown) that is arranged between an inner cylindrical side of the cartridge part 7*a* and an outer cylindrical side of the sleeve part 7*b* and makes a sliding movement relative to the cartridge part and the sleeve part.

Figure 5:
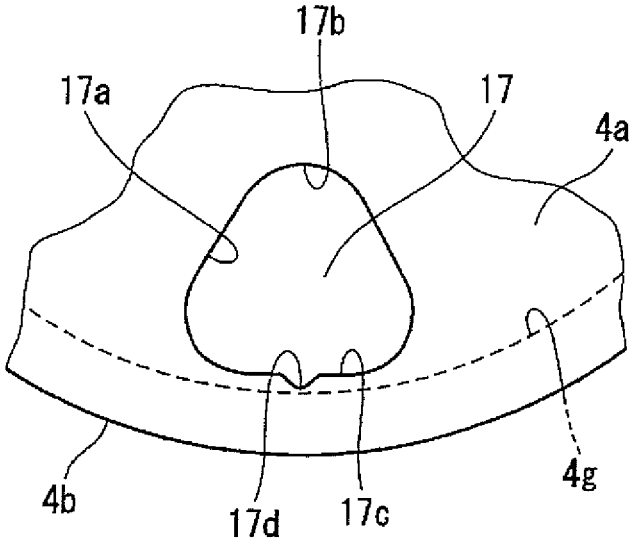
FIG. 5 is an enlarged view of a portion indicated by an arrow B of FIG. 4.

As is seen from FIGS. 4 and 5, the through openings 17 formed in the flange wall 4*a* of the pulley 4 are placed at an outer peripheral side of the flange wall 4*a*, and each through opening 17 is shaped like Japanese triangular rice ball (viz., Sankaku Onigiri) and has a top face 17*b* directed toward the center of the cylindrical part 4*e* and an arcuate bottom face 17*c* placed near the inner cylindrical surface 4*g* of the above-mentioned cylindrical base part 4*b*. In other words, as is seen from FIG. 5, the arcuate bottom face 17*c* is arranged to extend along the inner cylindrical surface 4*g* while being close to the inner cylindrical surface.

At a circumferentially middle position of each arcuate bottom face 17*c*, there is formed a pathway groove 17*d*. As is seen from FIGS. 4 and 5, the pathway groove 17*d* is provided at a radially outer edge of the corresponding through opening 17 of the flange wall 4*a* and has a generally V-shape in a transverse cross section, and the deepest point (or leading end) of the pathway groove 17*d* takes the same position as the position of the inner cylindrical surface 4*g* of the cylindrical base part 4*b*.

[Process for Producing the Pulley by Press-Forming (Method of Producing the Water Pump)]

In the following, the process for producing the pulley 4 by press-forming will be described with reference to FIGS. 6 to 11.

Figure 6:
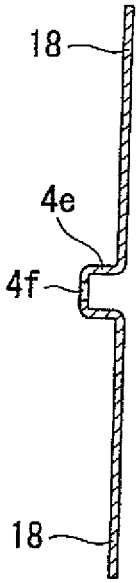
FIG. 6 is a vertically sectioned view of a pressed intermediate of the pulley, which is produced when being subjected to a pressing of a first process of a press forming.

In a first step, as is seen from FIG. 6, by handing a press tool of a press-forming machine, the above-mentioned cylindrical part 4*e* and the air bleed through opening 4*f* are formed at a central portion of a discal press-formed pulley body 18 at the same time.

Figure 7:
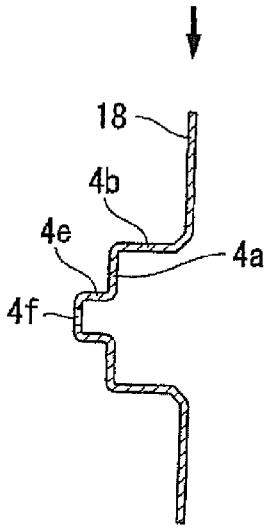
FIG. 7 is a vertically sectioned view of a pressed intermediate of the pulley, which is produced when being subjected to a pressing of a second process of the press forming.

In a second step, as is seen from FIG. 7, by handling a press tool, the flange wall 4*a* and the cylindrical base part 4*b* that surrounds the flange wall 4*a* are formed at the same time.

Figure 8:
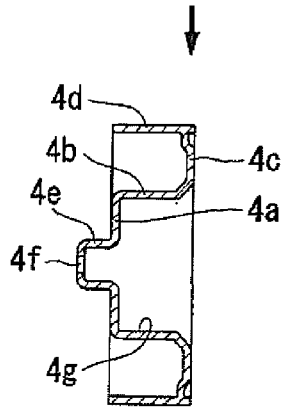
FIG. 8 is a vertically sectioned view of a pressed intermediate of the pulley, which is produced when being subjected to a pressing of a third process of the press forming.

In a third step thereafter, as is seen from FIG. 8, by handling a different press tool, the discal connecting wall 4*c* and the belt-holding part 4*d* are formed. With these steps, the press-formed pulley body 18 is shaped into a generally entire form of a finished pulley.

Figure 9:
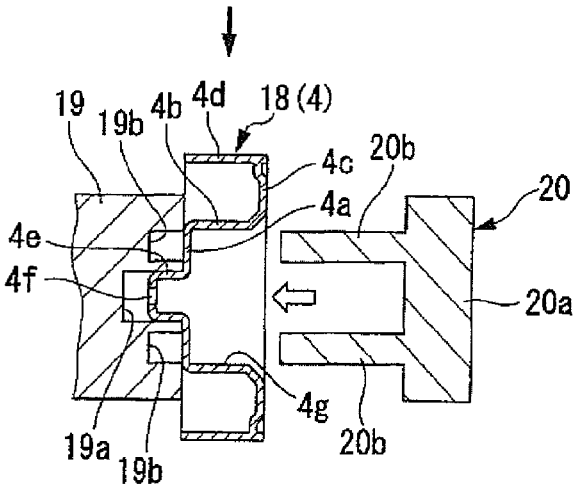
FIG. 9 is a vertically sectioned view of a press machine in a condition in which the press machine is about to make through holes in the pulley intermediate.

Then, in a fourth step, as is seen from FIG. 9, an outer end side of the press-formed pulley body 18 is supported by a supporting tool 19 in an axial direction. The supporting tool 19 has at a central portion thereof an engagement supporting groove 19*a* to and by which the above-mentioned cylindrical part 4*e* is engaged and supported and the supporting tool 19 has, at portions that surround the supporting groove 19*a* and correspond to positions where the above-mentioned through openings 17 are provided, six engaging holes 19*b*.

Figure 10:
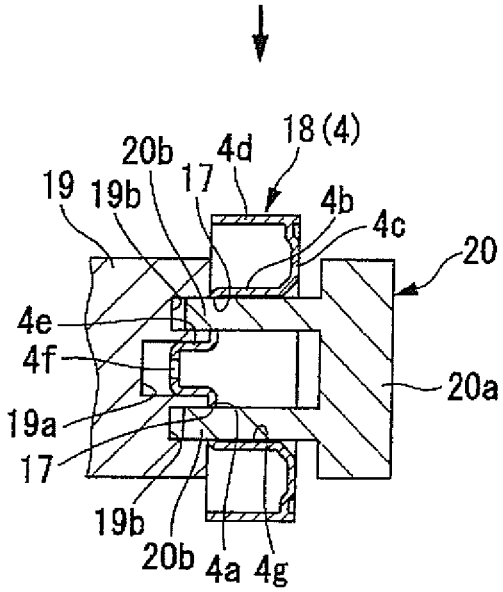
FIG. 10 is a vertically sectioned view of the press machine in a condition in which the press machine has made the through holes in the pulley intermediate.
Figure 11:
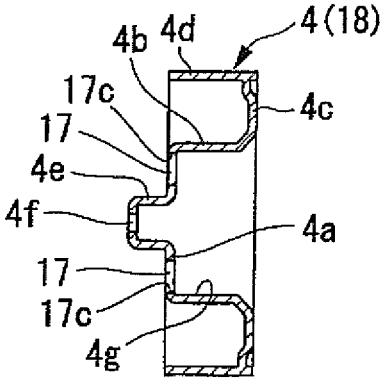
FIG. 11 is a vertically sectioned view of the pulley intermediate that has been just pressed.

Then, in a fifth step, as is seen from FIG. 10, to the press-formed pulley body 18 whose left part is previously and tightly supported by the supporting tool 19, a stamping tool 20 is applied from a right side and inserted into the cylindrical base part 4*b* of the pulley body 18 resulting in that the above-mentioned six through openings 17 are produced.

That is, the stamping tool 20 comprises a discal base part 20*a* and six punching rods 20*b* that are projected from a front end of the discal base part 20*a*, and each punching rod 20*b* has a transverse section that includes the triangular shape of the above-mentioned Japanese triangular rice ball (viz., Sankaku Onigiri) and the V-shape of the pathway groove 17*d* in section, that are provided for each through opening 17. The diameter of a circular path that connects radially outer edges of the six punching rods 20*b* is slightly smaller than a diameter of the inner cylindrical surface 4*g* of the cylindrical base part 4*b*, so that when the punching rods 20*b* are inserted into the cylindrical base part 4*b*, the radially outer edge of each punching rod 20*b* does not contact the inner cylindrical surface 4*g*.

Furthermore, in the present embodiment, considering the view of the transverse cross section of each punching rod 20*b*, the part corresponding to the cross section of the pathway groove 17*d* is made smaller than the part of the through opening 17 and the width length of the part corresponding to the pathway groove 17*d* is continuously reduced as the position is shifted radially outward. With this feature, even when, upon insertion of the punching rods 20*b* into the cylindrical base part 4*b*, a little shaft drift occurs, undesired contact of the radially outer edge of each punching rod 20*b* with the inner cylindrical surface 4*g* can be suppressed.

Accordingly, when the punching rods 20*b* of the stamping tool 20 are inserted into the cylindrical base part 4*b* to punch the flange wall 4*a* through the engaging holes 19*b* of the supporting tool 19, the six through openings 17 and the pathway grooves 17*d* are produced at the same time. With this action, a series of press-forming steps for the pulley 4 is finished.

As is mentioned hereinabove, in the present embodiment, the through openings 17 are formed at the outer peripheral side of the flange wall 4*a* and the leading ends of the pathway grooves 17*d* take the same position as the position of the inner cylindrical surface 4*g* of the cylindrical base part 4*b*, and thus, water, dust and the like that might be present in the cylindrical base part 4*b* can be effectively discharged to the outside.

That is, even when water that might leak from the mechanical seal 7 during operation of the pump flows to a front portion in the cylindrical base part 4*b* or even when water and dust intrude into the front portion in the cylindrical base part 4*b* through the through openings 17, such foreign things can be speedily discharged to the outside from a lower part of the inner cylindrical surface 4*g* of the cylindrical base part 4*b* particularly when the pump is stopped. Thus, the function of discharging water and the like from the interior of the cylindrical base part 4*b* to the outside is highly increased.

Accordingly, water and dust that might enter into the front area in the cylindrical base part 4*b* are suppressed from flowing toward the ball bearing 3, and thus, generation of rust inside the ball bearing 3 can be sufficiently suppressed.

Second Embodiment to Sixth Embodiment

FIGS. 12 to 16 show second to sixth embodiments of the present invention in which the shape of the through openings 17 changes.

Figure 12:
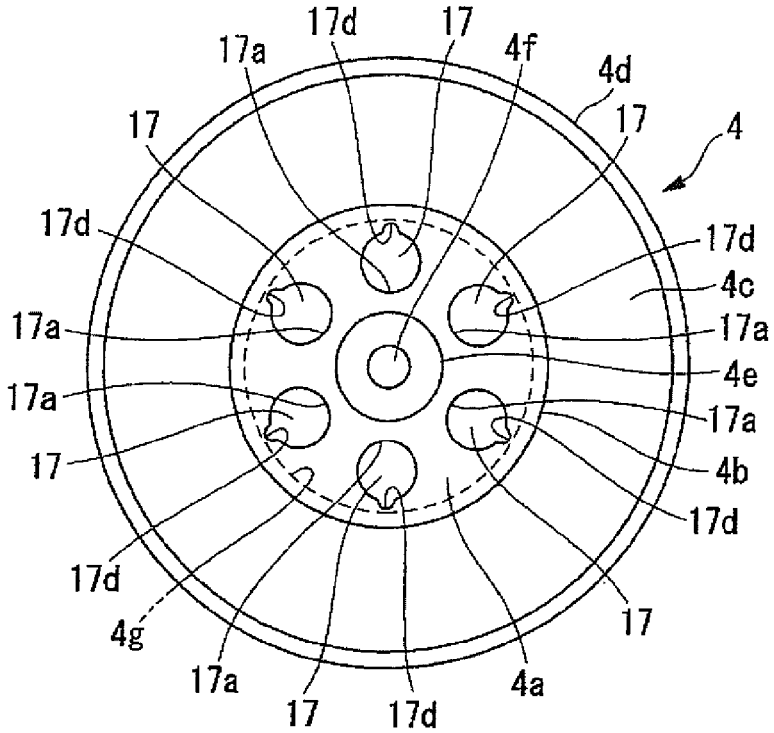
FIG. 12 is a front view of a pulley depicting a second embodiment of the present invention.

Each through opening 17 of the second embodiment shown in FIG. 12 is circular in shape and arranged in proximity to the inner cylindrical surface 4*g* of the cylindrical base part 4*b*, and each through opening is formed, at a radially outward edge of an inner surface 17*a* thereof, with a pathway groove 17*d* that has a generally V-shape in a transverse cross section. The leading end of each pathway groove 17*d* takes the same position as the position of the inner cylindrical surface 4*g* of the cylindrical base part 4*b*.

Figure 13:
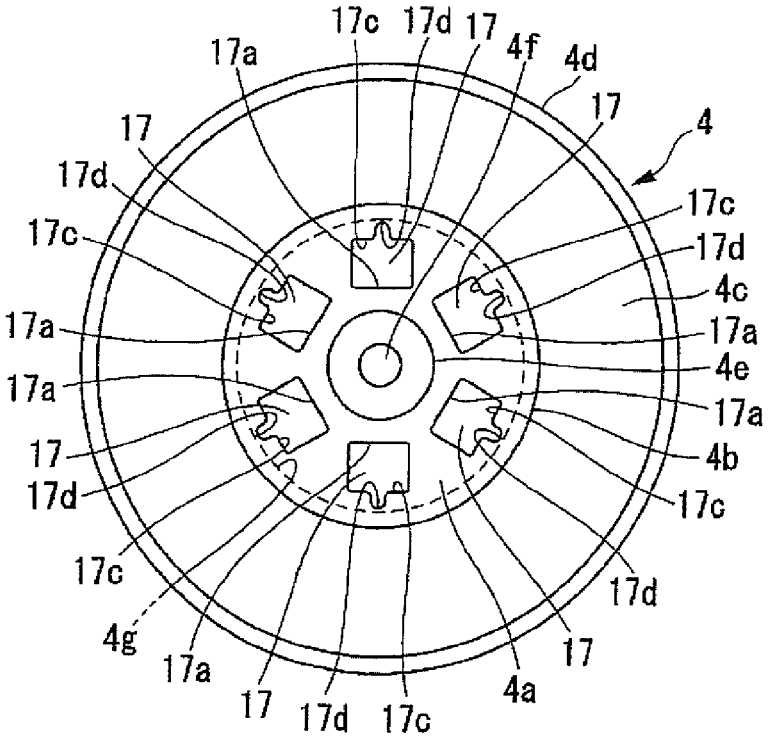
FIG. 13 is a front view of a pulley depicting a third embodiment of the present invention.

Each through opening 17 of the third embodiment shown in FIG. 13 is rectangular in shape and arranged in proximity to the inner cylindrical surface 4*g* of the cylindrical base part 4*b*, and each through opening is formed, at an outside bottom part 17*c* of the inner surface 17*a*, that is, at the bottom face 17*c* of the radially outward edge of the flange wall 4*a*, with a pathway groove 17*d* that has a generally V-shape in a transverse cross section. The leading end of each pathway groove 17*d* takes the same position as the position of the inner cylindrical surface 4*g* of the cylindrical base part 4*b*.

Figure 14:
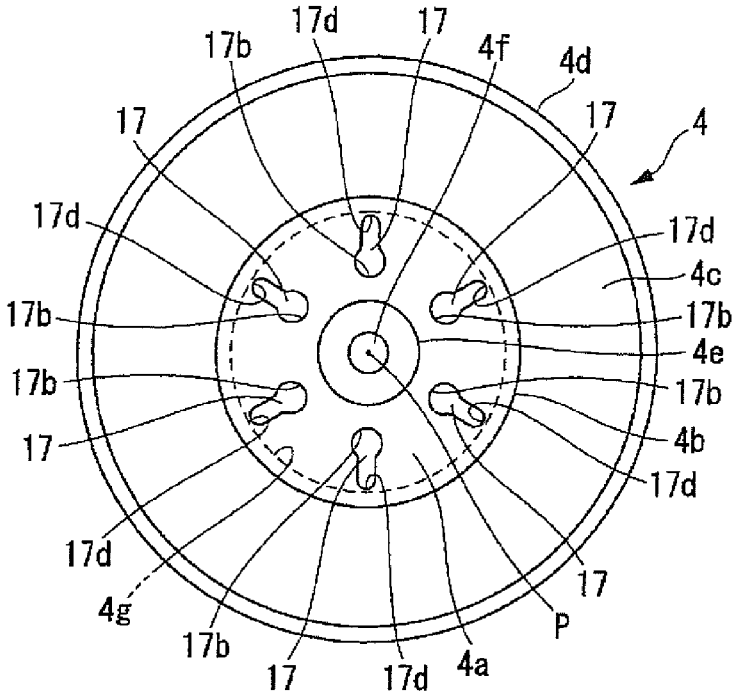
FIG. 14 is a front view of a pulley depicting a fourth embodiment of the present invention.

Through openings 17 of the fourth embodiment shown in FIG. 14 are arranged to extend radially outward from a center P of the flange wall 4*a*, and each through opening is an elongate opening and at a portion that is radially outwardly spaced from an inner circular top surface 17*b* of each elongate through opening 17, there is formed a pathway groove 17*d*. This pathway groove 17*d* is U-shaped, and the leading end of the pathway groove takes the same position as the position of the inner cylindrical surface 4*g* of the cylindrical base part 4*b*.

Figure 15:
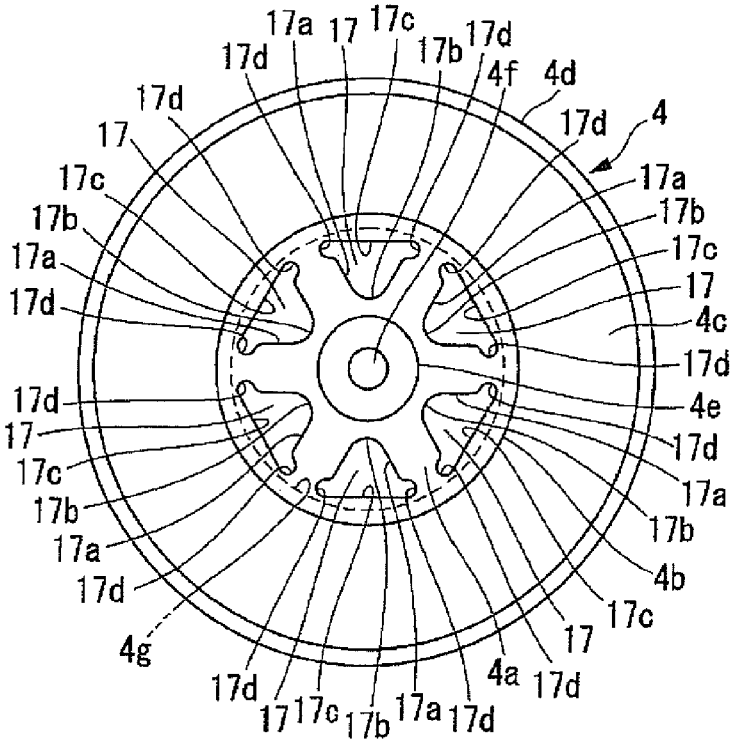
FIG. 15 is a front view of a pulley depicting a fifth embodiment of the present invention.

Each through opening 17 of the fifth embodiment shown in FIG. 15 has an inner curved surface 17*a* shaped like a cap and the through openings 17 are placed near the inner cylindrical surface 4*g* of the cylindrical base part 4*b*, and each top surface 17*b* is directed toward the center P of the flange wall 4*a*, and at opposed ends of a bottom surface 17*c* that constitute a flange shape, there are formed two pathway grooves 17*d* and 17*d*. Each of these two pathway grooves 17*d* and 17*d* is shaped "U" in a transverse cross section, and the leading end of each pathway groove takes the same position as the position of the inner cylindrical surface 4*g* of the cylindrical base part 4*b*.

Figure 16:
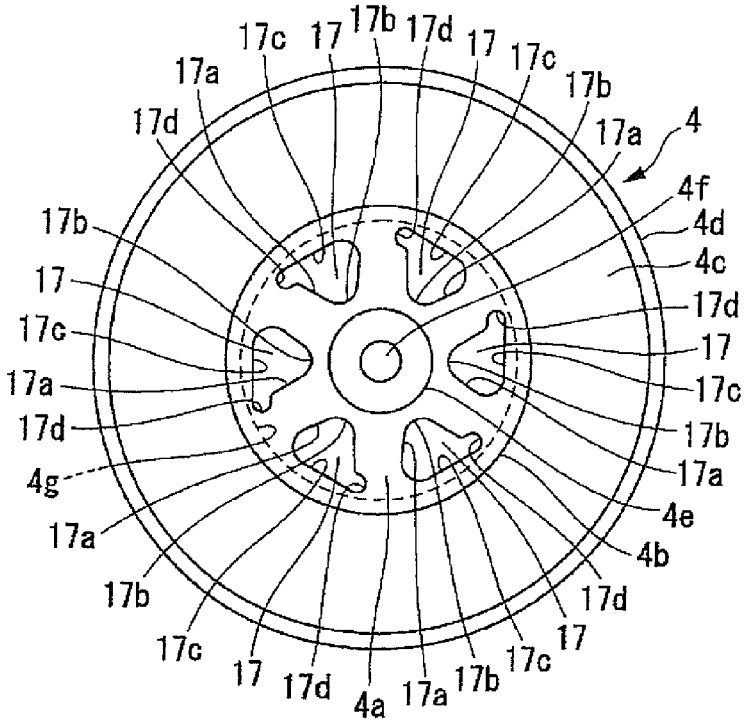
FIG. 16 is a front view of a pulley depicting a sixth embodiment of the present invention.

Each through opening 17 of the sixth embodiment shown in FIG. 16 is shaped generally triangular and placed near the inner cylindrical surface 4*g* of the cylindrical base part 4*b*, and each top surface 17*b* is directed toward the center P of the flange wall 4*a*, and at one end of a bottom surface 17*c*, there is formed a pathway groove 17*d*. Each pathway groove 17*d* has a generally U-shape, and the leading end of the groove 17*d* takes the same position as the position of the inner cylindrical surface 4*g* of the cylindrical base part 4*b*.

Accordingly, due to presence of the pathway groove 17*d* (17*d*) of each through opening, the above-mentioned second to sixth embodiments have such an operation effect that the performance for discharging water and dust is increased like in case of the first embodiment.

In case of the fifth embodiment, due to presence of the two pathway grooves 17*d* and 17*d*, the performance for discharging water and dust is much increased.

Seventh and Eighth Embodiments

Figure 17:
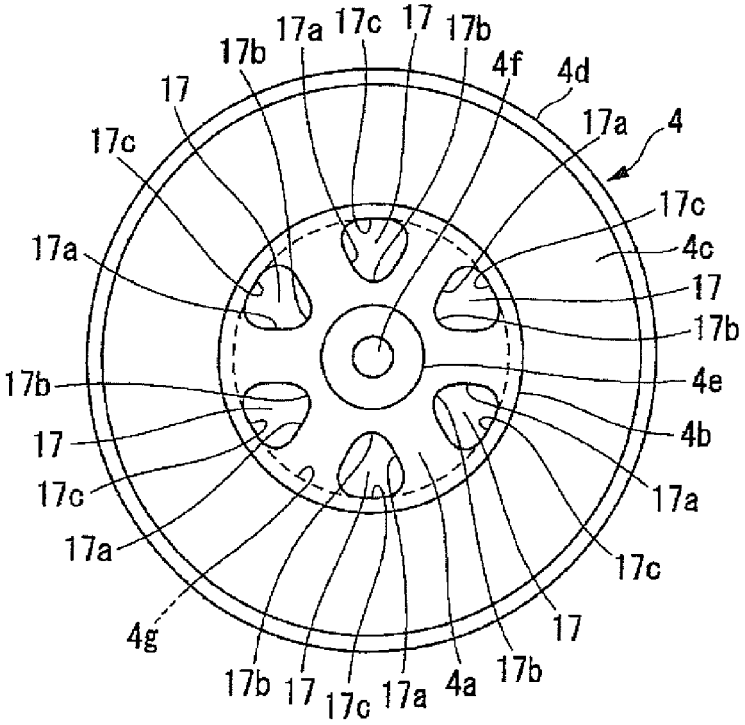
FIG. 17 is a front view of a pulley depicting a seventh embodiment of the present invention.
Figure 18:
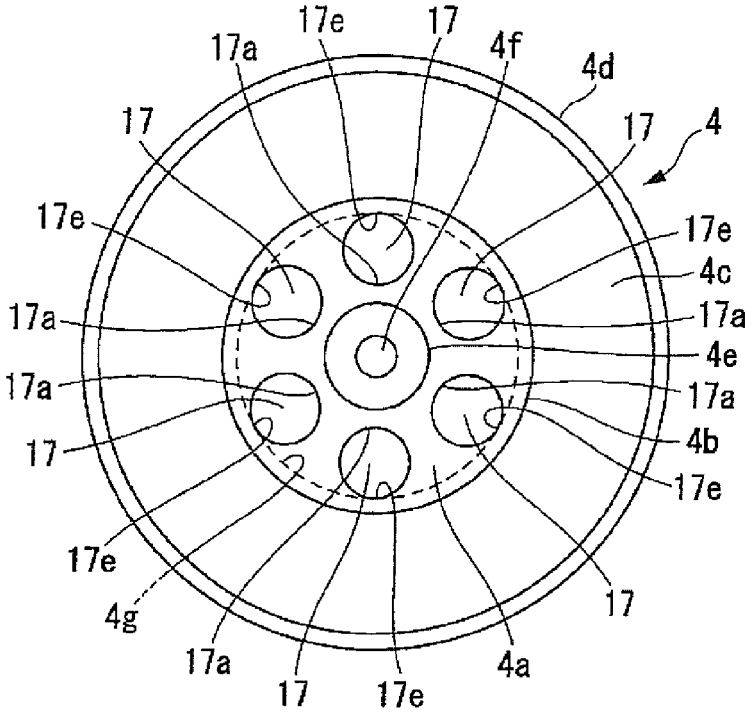
FIG. 18 is a front view of a pulley depicting an eighth embodiment of the present invention.

FIGS. 17 and 18 show seventh and eighth embodiments of the present invention in which the arrangement of the through openings 17 is changed and the pathway grooves are removed.

That is, each through opening 17 of the seventh embodiment shown in FIG. 17 has an inner surface 17*a* shaped like a triangular rice ball like in the first embodiment, and each through opening 17 has both a top face 17*b* directed toward the center of the flange wall 4*a* and a bottom face 17*c* formed at the outer cylindrical surface side of the flange wall 4*a*, and the bottom face 17*c* takes the same position as the position of the inner cylindrical surface 4*g* of the cylindrical base part 4*b*. That is, the bottom face 17*c* per se takes the same position as the position where the inner cylindrical surface 4*g* is formed, unlike in the case of the first to sixth embodiments wherein the pathway groove takes the same position as the position of the inner cylindrical surface 4*g*.

Accordingly, in this embodiment, water that might enter into the interior of the cylindrical base part 4*b* is discharged to the outside while being guided through the relatively broad bottom face 17*c* of the through opening 17, and thus, a flow resistance becomes small and thus the discharge performance is further increased.

Each through opening 17 of the eighth embodiment shown in FIG. 18 has an inner surface 17*a* shaped circular like in case of the second embodiment, and an outer edge 17*e* of each inner surface 17*a* takes the same position as the position of the inner cylindrical surface 4*g* of the cylindrical base part 4*b*. That is, in this eighth embodiment, the outer edge 17*e* per se takes the same position as the position where the inner cylindrical surface 4*g* is produced, unlike in the case of the second embodiment wherein the pathway grooves are provided and each pathway groove takes the same position as the position of the inner cylindrical surface 4*g*.

Accordingly, also in this embodiment, the water that might enter into the interior of the cylindrical base part 4*b* is discharged to the outside while being guided through the relatively broad outer edge 17*e* of the through opening 17, and thus, a flow resistance becomes small and thus the discharge performance is further increased.

Ninth and Tenth Embodiments

Figure 19:
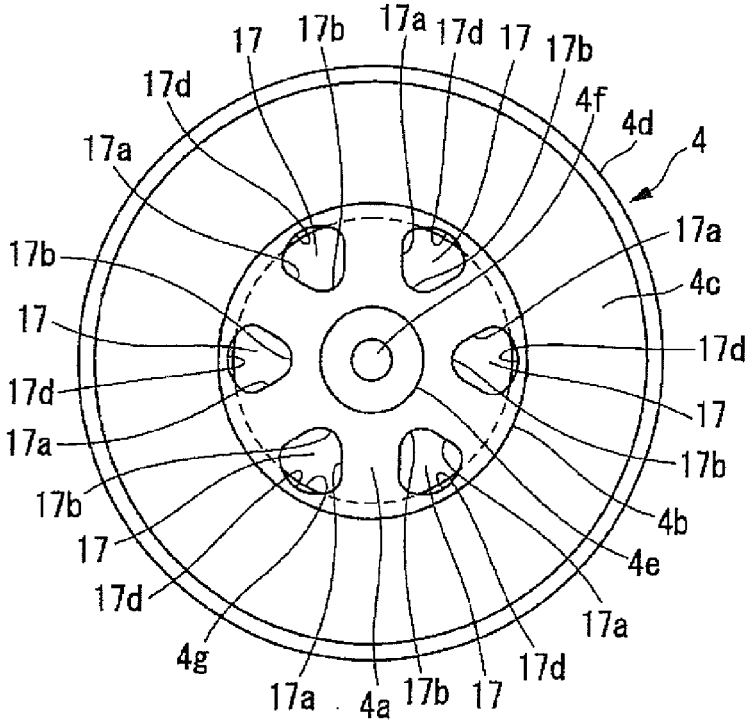
FIG. 19 is a front view of a pulley depicting a ninth embodiment of the present invention.
Figure 20:
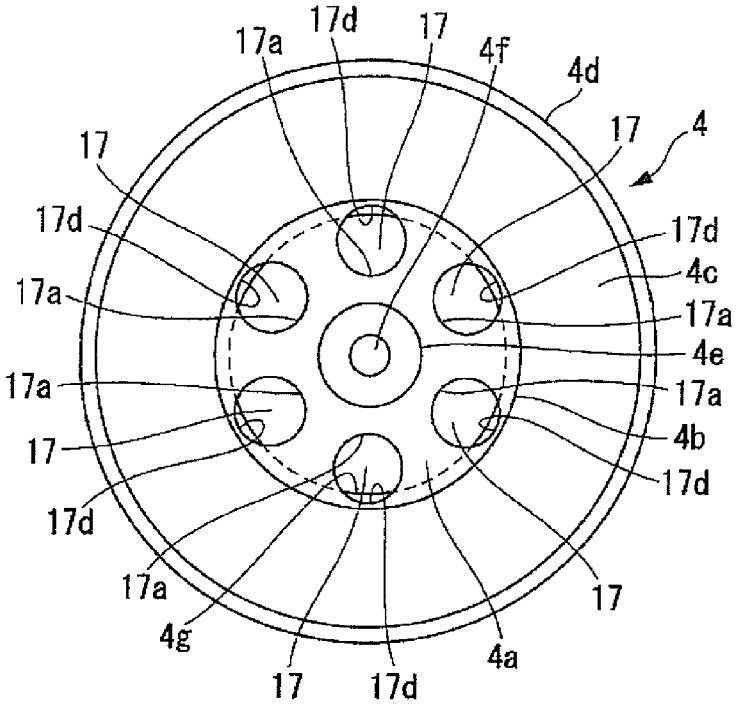
FIG. 20 is a front view of a pulley depicting a tenth embodiment of the present invention.

FIGS. 19 and 20 show ninth and tenth embodiments of the present invention in which the arrangement and shape of the through openings 17 are further changed.

That is, each through opening 17 of the ninth embodiment shown in FIG. 19 has an inner surface 17*a* shaped like a rain drop and comprises a top surface 17*b* directed toward the center of the flange wall 4*a*, a bottom surface formed at a radially outer end side of the flange wall 4*a* and a pathway groove 17*d* with an arcuate cross section that is formed at a generally middle portion of the bottom surface.

The pathway groove 17*d* is placed at a position radially outside the position of the inner cylindrical surface 4*g* of the cylindrical base part 4*b*. That is, the pathway groove has a stepped surface that is depressed by one step relative to the inner cylindrical surface 4*g*, unlike in the case of the above-mentioned embodiments in which each pathway groove takes the same position as the position of the inner cylindrical surface 4*g*.

Accordingly, in this embodiment, the water that might enter into the interior of the cylindrical base part 4*b* is discharged to the outside while being guided through the broad and low stepped pathway groove 17*d* of the through opening 17, and thus, a discharging flow speed of the water is increased and thus the discharge performance is much more increased.

This special construction can exhibit a satisfied discharge performance regardless of the position where the through openings 17 take at the time when the pump is now working.

Each through opening 17 of the tenth embodiment shown in FIG. 20 has an inner surface 17*a* shaped circular and a pathway groove 17*d* with an arcuate cross section that is provided at a radially outer end of the circular inner surface.

Like in the ninth embodiment, the pathway groove 17*d* is placed at a position radially outside the position of the inner cylindrical surface 4*g* of the cylindrical base part 4*b*. That is, the pathway groove has a stepped surface that is depressed by one step relative to the inner cylindrical surface 4*g*.

Accordingly, in this embodiment, the discharge performance for water and the like is increased like the ninth embodiment.

Eleventh Embodiment

Figure 21:
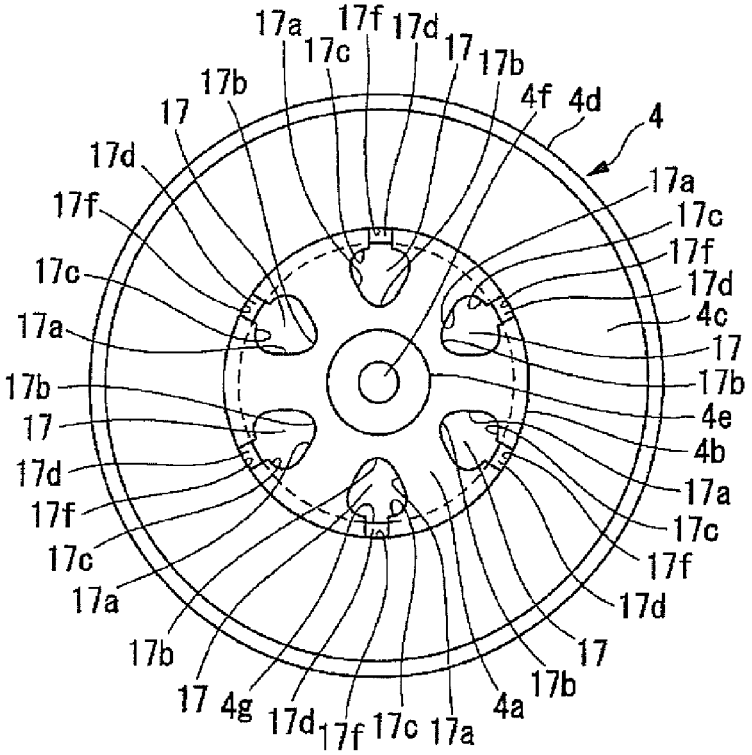
FIG. 21 is a front view of a pulley depicting an eleventh embodiment of the present invention.

FIG. 21 shows an eleventh embodiment, and in this embodiment, the basic shape and position of the inner surface 17*a* of each through opening 17 are the same as those of the first embodiment, and the inner surface 17*a* is shaped like a triangular rice ball and has the top surface 17*b* and the bottom surface 17*c*. However, in this embodiment, there is provided a pathway groove 17*d* that extends radially outward from the bottom surface 17*c*.

The pathway groove 17*d* is an elongate cut shaped rectangular and extends radially outward from the bottom surface 17*c*, and a radially outer edge 17*f* of the pathway groove extends to the outer cylindrical surface of the cylindrical base part 4*b* passing over the inner cylindrical surface 4*g* of the cylindrical base part 4*b* thereby to constitute an entire construction shaped like a gutter.

Accordingly, in this embodiment, the water and the like that might enter into the interior of the cylindrical base part 4*b* is directly led to the pathway groove 17*d* of the through opening 17 from a lower part of the inner cylindrical surface 4*g* of the cylindrical base part 4*b* and continuously moved downward and discharged to the outside. Accordingly, the water discharge performance is further increased.

The invention claimed is:

1. A water pump comprising:

a pump housing having a cylindrical portion at an axial end;

a drive shaft rotatably supported in the pump housing;

a pulley including a discal end wall that is connected to an end portion of the drive shaft and a cylindrical base part that is integrally connected to an outer periphery of the discal end wall and shaped to surround the cylindrical portion;

a bearing that is interposed between the cylindrical base part and the cylindrical portion to rotatably bear the drive shaft; and an impeller that is connected to the other end of the drive shaft to rotate integrally, wherein the discal end wall is formed with a plurality of through openings that communicate an inside with an outside of the discal end wall, relative to a rotational axis of the water pump, each of the through openings defines, at a location on each through opening that is most radially distant from the rotational axis of the water pump, a pathway groove that extends substantially along an inner cylindrical surface of the cylindrical base part, an opening area of the pathway groove is smaller than that of the corresponding through opening, a width of the pathway groove is reduced as the pathway groove extends radially outward, and the pathway groove extends through the discal endwall along a direction that is parallel to a longitudinal axis of the drive shaft.

2. A water pump as claimed in claim 1, wherein a width of the through opening is increased as the through opening extends radially outward.

3. A water pump as claimed in claim 2, wherein a cross-section of the through opening has a triangular shape.

4. A water pump as claimed in claim 1, wherein the through openings of the discal end wall are arranged in a circumferential direction at evenly spaced intervals.

5. A water pump as claimed in claim 1, wherein each of the through openings is circular.

6. A water pump as claimed in claim 1, wherein each of the through openings is elliptical.

7. A water pump as claimed in claim 1, wherein each of the through openings is rectangular.

8. A water pump as claimed in claim 1, wherein the pathway groove is arcuate in a transverse cross section.

9. A water pump as claimed in claim 8, wherein the pathway groove is one of a plurality of pathway grooves respectively provided by the through openings.

10. A water pump as claimed in claim 1, wherein the bearing is a ball bearing including an inner race fixed to the cylindrical portion, an outer race fixed to the cylindrical base part and balls operatively disposed between the inner and outer races.

* * * * *